United States Patent [19]

Fujiwara et al.

[11] 4,244,647

[45] Jan. 13, 1981

[54] ERASING DEVICE FOR IMAGE TRANSFER TYPE COPYING APPARATUS

[75] Inventors: Takao Fujiwara, Toyokawa; Yoshitaro Furukawa, Toyohashi, both of Japan

[73] Assignee: Minolta Camera Kabushiki Kaisha, Osaka, Japan

[21] Appl. No.: 23,249

[22] Filed: Mar. 23, 1979

[30] Foreign Application Priority Data

Apr. 7, 1978 [JP] Japan ..... 53-46020[U]

[51] Int. Cl.[3] ..... G03G 15/00

[52] U.S. Cl. ..... 355/14 R; 355/3 CH

[58] Field of Search ..... 355/14 R, 14 TR, 14 CH, 355/15, 7, 3 R, 3 CH

[56] References Cited

U.S. PATENT DOCUMENTS

| | | | |
|---|---|---|---|
| 3,700,328 | 10/1972 | Davidge et al. | 355/14 R |
| 3,778,148 | 12/1973 | Fujitsuka et al. | 355/14 R |
| 4,113,374 | 9/1978 | Nakamura et al. | 355/14 TR |

*Primary Examiner*—R. L. Moses

*Attorney, Agent, or Firm*—Watson, Cole, Grindle & Watson

[57] ABSTRACT

In an image transfer type copying apparatus including an image exposure station having an exposure lamp for successively projecting an image of the original onto a photosensitive member, charging means disposed around the photosensitive member for charging the surface of the photosensitive member, a developing station for developing an electrostatic latent image, a transfer station for transferring the developed image onto a copying member and a cleaning station for cleaning the residual toner, the improvement consists of an erasing station for erasing unnecessary charges formed by the charging station which remains operative even after formation of the latent image. A controller energizes the erasing lamp while the exposure lamp is still lit with the exposure lamp being effectively energized even after completion of exposure of the image. The erasing station is energized when the trailing edge of the latent image reaches a position not influenced by the erasing operation.

6 Claims, 4 Drawing Figures

ERASING DEVICE FOR IMAGE TRANSFER TYPE COPYING APPARATUS

BACKGROUND OF THE INVENTION

1. Field of the Invention

The present invention relates to an erasing device for image transfer type copying apparatus, and more particularly to an erasing device for erasing unnecessary charges from a photosensitive member of such apparatus.

2. Prior Art

While there have been proposed various erasing devices such as those described in U.S. Pat. Nos. 3,778,148, 3,746,442 and 3,960,446, each of these devices is either at least structurally or functionally complicated. In the erasing device described in U.S. Pat. No. 3,778,148, a shutter is required to intercept an erasing light which makes the device rather complicated structurally. Similarly, U.S. Pat. No. 3,746,442 requires a light reflective shield which is automatically moved by inertia between the light source and document holder. However, the erasing device described in U.S. Pat. No. 3,960,446 is rather simple structurally but instead requires an erasing lamp and an image exposure lamp to be energized alternatively. However, there is a problem with this device in that the trailing end of the electrostatic latent image formed may become erased by the erasing lamp since the erasing lamp is energized to be lit simultaneously with the extinguishment of the exposure lamp. Thus, there is a need for a novel erasing device free of these drawbacks.

Although the erasing devices described above are primarily concerned with erasing of unnecessary charges resulting from operation of the corona charging means for charging the surface of the photosensitive member prior to image exposure wherein the charging means is continuously operated, there is a copying apparatus such as that shown in U.S. Pat. No. 3,122,634 in which the means for charging the photosensitive member as well as another charging means for effecting transfer of the image onto the copying paper are controlled by a single transformer. The use of a single transformer is particularly effective from the consideration of economy and simplification of electrical control for the copying apparatus, and also effective for improvement of the charging characteristic of short length charging means used in small size copying apparatus capable of producing copies on post cards or small cards.

However, the use of a single transformer to operate both charging means, i.e., means to charge the surface of the photosensitive member and means to effect transfer of the image, will create a problem in its control since one of the charging means cannot be deenergized while the other is continued to be energized. Thus, at least one of these charging means will remain operated even when it is unnecessary, thereby causing more surface area of the photosensitive member to become charged as compared with conventional copying apparatus in which both charging means are controlled by separate transformers. Unless these charges are erased, they will be developed with toner by developing means leading to waste of toner and placing an over-load on the cleaning means. Thus, even if a suitable erasing means is provided to avoid such drawbacks, the operational control thereof would become quite complicated unless some further measures are taken.

SUMMARY OF THE INVENTION

It is accordingly a primary object of the present invention to provide a novel and improved erasing device for image transfer type copying apparatus.

Another object of the present invention is to provide an improved erasing device for erasing unnecessary charges from a photosensitive member in which the control thereof is relatively simple.

Still another object of the present invention is to provide an improved erasing device for image transfer type copying apparatus in which a single transformer is used to control means for charging the surface of the photosensitive member as well as charging means for transferring the image onto the copying member.

These and other objects of the present invention are achieved by providing an erasing device for image transfer type copying apparatus which includes first and second erasing means, with the former adapted to erase unnecessary charges resulting from charging means for transferring an image, and the latter adapted to erase unnecessary charges resulting from means for charging the photosensitive member prior to image exposure.

For a fuller understanding of the nature and objects of the present invention, reference is made to the following detailed description taken in conjunction with the accompanying drawings.

DESCRIPTION OF THE PREFERRED EMBODIMENTS

Figure 1:
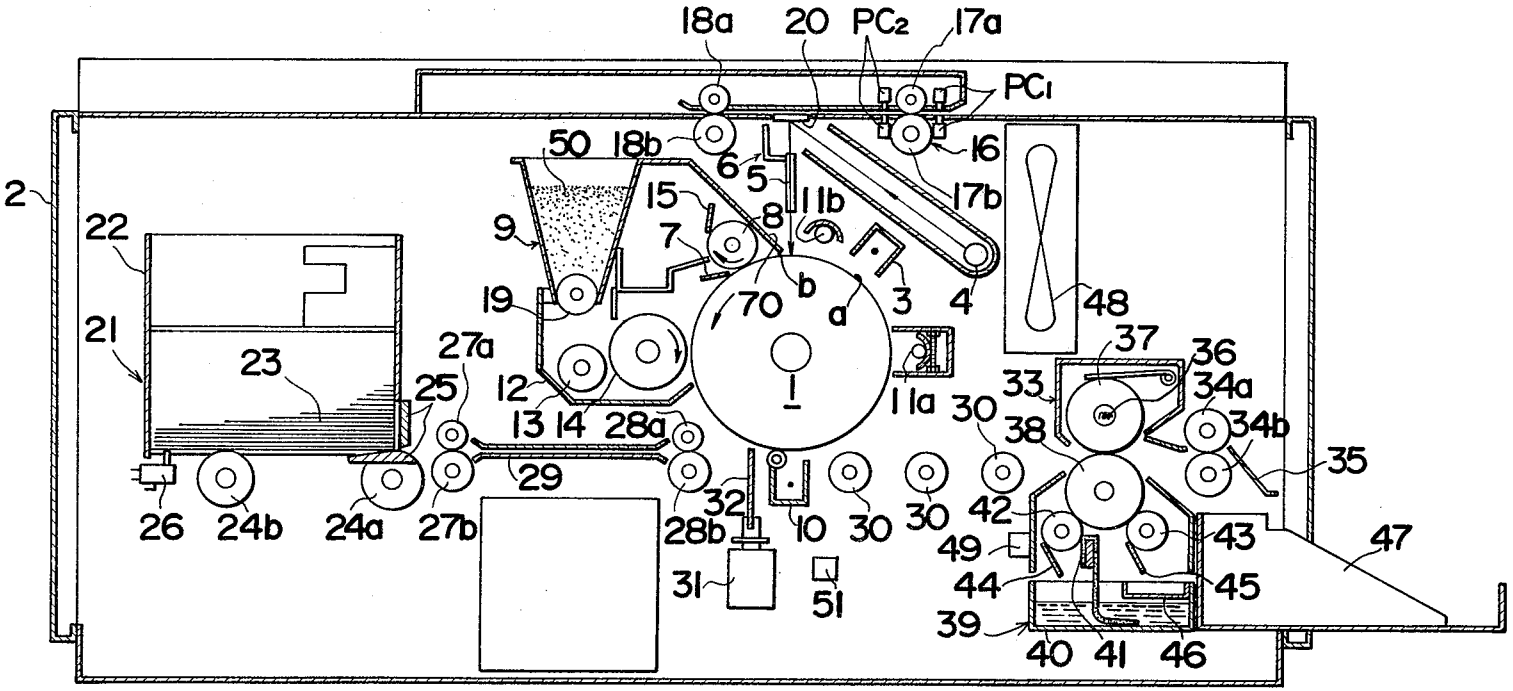
FIG. 1 is a cross-sectional view of image transfer type copying apparatus with the erasing device of the present invention.

Referring to FIG. 1, there is shown image transfer type copying apparatus 2 particularly suited to produce copies on small size cards such as post cards and library cards. In the apparatus, photosensitive member 1, in the form of a drum, is rotated counterclockwise, and includes a photoconductive layer of suitable material on its surface. Provided around photosensitive drum 1 are corona charging means 3 for charging the surface of drum 1; second erasing lamp **11*b* for erasing unnecessary charges resulting from the operation of charging means 3; image exposure means 6 including exposure lamp 4 and light guide 5 formed by a bundle of optical fibers of graded refractive index; a residual toner cleaning means including cleaning blade 7 and toner collecting roller 8; devloping means 9 for developing an electrostatic latent image formed on drum 1; second corona charging means 10 for transferring developed image onto copying paper; and first erasing lamp 11*a* for erasing unnecessary charges resulting from operation of charging means 10**.

Developing means 9 is so arranged that toner 50 supplied to container 12 by replenishing means 19 is agitated with carriers by means of agitating roller 13 and then transported onto rotating developing sleeve 14 to successively develop an electrostatic latent image.

Sleeve 14 includes therein only a single permanent magnet confronting the side of agitating roller 13, and with the attracting force of the magnet, developer is transported onto the surface of sleeve 14. As the sleeve is rotated, developer cascades onto the latent image thereby developing the same.

Further, toner collecting roller 8 is provided close to the surface of drum 1 in a position between cleaning blade 7 and shield casing 70 and is so arranged to be triboelectrically charged to a polarity opposite to the polarity of toner by a thin leaf made of rubber, metal or other suitable material. Collecting roller 8 electrostatically attracts toner scraped off by cleaning blade 7 and the collected toner is removed therefrom by thin leaf 15 and fed back into container 12. As will be explained further hereinbelow, shield casing 70 is adapted to shield light so that photosensitive drum 1 past point b is free of influence from exposure lamp 4 and second erasing lamp 11*b*.

Disposed at the top portion of apparatus 2 is original transporting means 16 which includes two pairs of original transporting rollers 17*a*, 17*b*, 18*a* and 18*b* for transporting an original to be copied over transparent glass plate 20. Transporting rollers 17*a*, 17*b*, 18*a* and 18*b* are rotatable in both directions to reciprocatingly feed an original. The original is transported from right to left for projection of an image onto drum 1 and fed back from left to right for the next copying cycle or for replacement with another original. At both sides of the pair of transporting rollers 17*a* and 17*b*, there is provided first and second photocouplers or photo-detection means PC1 and PC2, each consisting of a light emitting element and a light receiving element. First photo-detection means PC1 is adapted to detect the leading edge of the original as the same is manually fed in and energizes an original forwarding clutch (not shown) to rotate respective rollers 17*a*, 17*b*, 18*a* and 18*b* to transport the original leftwards over the glass plate 20. Detection means PC1 also functions as a print initiating switch to start the copying operation. Second photo-detection means PC2 similarly detects the leading edge of the original as it is fed forwardly to control the copying operational sequences.

Cards 23 or copying papers are stored in stacked fashion in casing 22 of card storing means 21 and adapted to be fed one-by-one from the lowermost card by feeding rollers 24*a* and 24*b*. In close vicinity to feeding roller 24*a*, guiding members 25 are provided to prevent double feeding of cards by ensuring that only a single card is fed at a time. Micro-switch 26 at the bottom of casing 22 detects the presence of cards and warns an operator when all cards are depleted. A feeding path for cards 23 from casing 22 includes first and second pairs of transporting rollers 27*a*, 27*b*, 28*a* and 28*b*, guide plate 29 between these rollers and three transporting rollers 30 leading to fixing means 33. Rollers 30 are either made of rubber of high frictional factor or other suitable material treated with knurling to have a high frictional factor. Also, in a position immediately adjacent the second corona charging means 10, stopper 32, movable in and out of the feeding path by the actuation of solenoid 31, is provided to temporarily suspend the feeding of cards 23. Specifically, stopper 32 engages a leading edge of the card fed by first and second transporting rollers 27*a*, 27*b*, 28*a*, 28*b* to temporarily stop the feeding of cards for the purpose of synchronization with the leading edge of the image formed on drum 1, and moves out of the feed path by the actuation of solenoid 31 to continue feeding of the cards to the image transfer station where the image on drum 1 is transferred onto the card in perfectly aligned fashion.

Disposed to the right of transporting rollers 30 to form the trailing end portion of the feed path are image fixing means 33, a pair of discharge rollers 34*a*, 34*b* and discharge guide 35. Fixing means 33 includes heating roller 37 with a fusing heater therein and pressure roller 38 in contact therewith. Beneath pressure roller 38, silicone oil coating means 39 is provided to prevent off-setting of toner and includes oil reservoir 40 containing silicone oil, coating roller 42 contacting pressure roller 38 to coat oil thereon with oil supplied through coating felt extending from reservoir 40 to coating roller 42, cleaning roller 43 contacting pressure roller 38 for cleaning the surface thereof, and first and second scraper blades 44, 45 engaging rollers 42 and 43. First blade 44 scrapes off excess oil from the surface of coating roller 42 into reservoir 40 for the purpose of reuse, whereas second blade 45 scrapes off from the surface of cleaning roller 43 any dust or used oil collected from pressure roller 38 and deposits them in dust box 46.

Discharge guide 35 is disposed at an inclined angle relative to the discharge direction of the card from discharge rollers 34*a*, 34*b* for the purpose of removing curling or bending of card 23. Such an arrangement is necessary particularly for the case of the use of relatively thick cards as in the embodiment of the present invention since fixing of image should preferably be effected by heating from the image side with an upper heating roller. As a consequence, card 23 tends to become curled due to heating from one side and pressure from pressure roller 38. With discharge guide 35 disposed in the above manner, it forcibly curves the card in the opposite direction to remove the curl therefrom. As to the other elements shown in FIG. 1, numeral 47 designates a tray for receiving copied cards discharged out of the apparatus, 48 is a cooling fan, 49 is a preheater and 51 is a dehumidifying heater.

Figure 2:
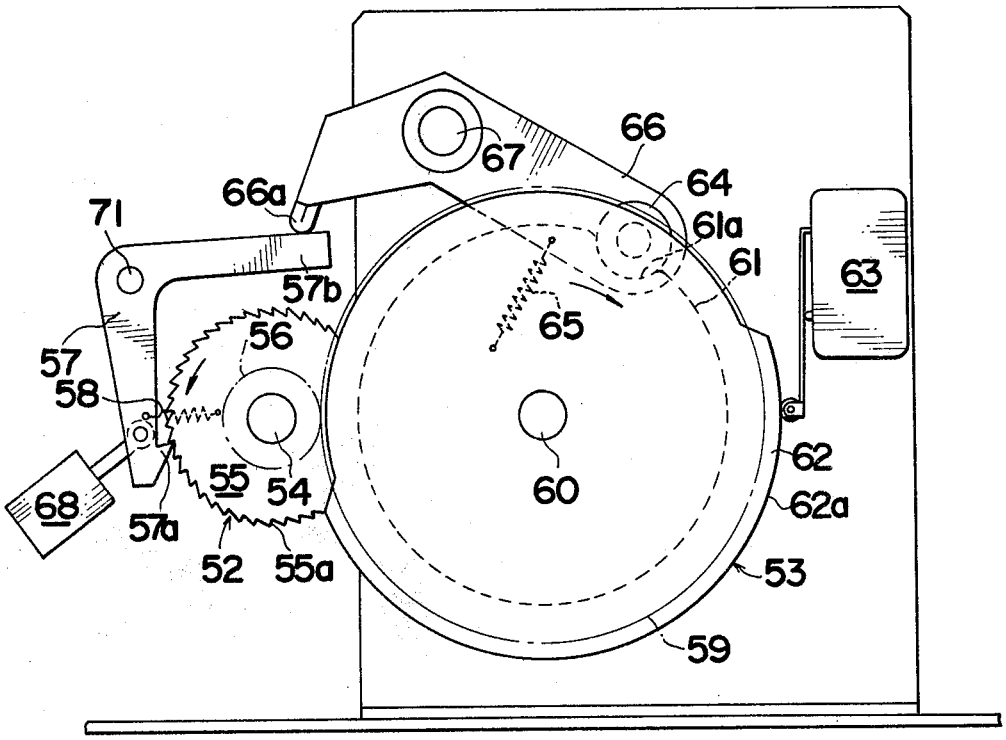
FIG. 2 is a front view of the control mechanism for the copying apparatus of FIG. 1.

Referring now to FIG. 2 which shows control cam mechanism 53 interlocked to clutch mechanism 52 to control copying operation sequences, clutch mechanism 52 includes on shaft 54 clutch disc 55 and clutch gear 56 integral with one another. Shaft 54 is driven by a chain or other suitable means from photosensitive drum 1 and disc 55 and gear 56 rotate therewith through frictional force. Engaging lever 57 is pivotally provided about axis 71 and urged by spring 58 in a manner to engage pawl 57*a* with ratchet wheel 55*a* formed on the outer periphery of clutch disc 55. Pawl 57*a* of engaging lever 57 is disengageable from ratchet wheel 55*a* by control solenoid 68 and normally engages with ratchet wheel 55*a* to prevent rotations of clutch disc 55 and clutch 56 relative to shaft 54.

Control cam mechanism 53 includes on shaft 60, having a fixedly provided cam gear 59 in engagement with clutch gear 56, position detecting cam 61 formed with notched portion 61*a* and a plurality of control cams 62 respectively formed with projected portions 62*a*. Microswitches 63 are provided at proper positions for each of control cams 62 and these switches are actuatable sequentially by projecting portions 62*a* of cams 62 to control the copying operation. Control lever 66 is rotatable about axis 67 and includes roller 64 at one end which engages notched portion 61*a* of position detecting cam 61 by the force of spring 65 to prevent rotation of cam 61, and stopper 66*a* at the other end which contacts trailing end 57*b* of engaging lever 57. Lever 66 rotates counterclockwise against the tension of spring 65 when engaging lever 57 is rotated clockwise against the force of spring 58 by the actuation of control solenoid 68 to release engagement of clutch disc 55, and thereby roller 64 moves out of notched portion 61*a* of position detecting cam 61. Consequently, clutch disc 55 and clutch gear 56 begin to rotate by shaft 54 and similarly rotates shaft 60 through gear 59. Thus, detecting cam 61 as well as control cams 62 are rotated to actuate various switches 63 to control the necessary copying operation as drum 1 is rotated. And when cam 61 has made one full rotation, notched portion 61*a* receives roller 64 of control lever 66 by the force of spring 65 to stop the rotations of cam 61 as well as control cams 62. Simultaneously therewith, the pushing action of stopper 66*a* on the trailing end 57*b* of engaging lever 57 is released to re-engage pawl 57*a* with ratchet wheel 55*a* by the force of spring 58, thereby locking clutch disc 55 and clutch gear 56 to stop the rotation thereof which completes a single cycle of copying operation.

Figure 3:
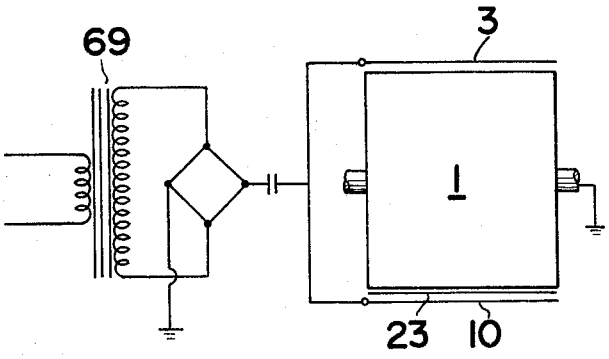
FIG. 3 is an electrical circuit for the charging means controlled by a single transformer.

Corona charging means 3 and 10 are operated by a single high tension transformer 69 as shown in FIG. 3 and charges the surface of photosensitive drum 1 and the card 23 to a specific polarity. Both charging means 3 and 10 are energized when second photo-detection means PC2 detects the leading edge of the original and remains energized until one of control cams 62 turns off a corresponding microswitch 63. However, first erasing lamp 11*a* is energized simultaneously with the detection of the leading edge of the original by first photo-detection means PC1 and remains energized until the entire copying operation is completed by the use of a timer (not shown) which completes its timing operation upon termination of the copying operation. In this way, first erasing lamp 11*a* not only serves to erase unnecessary charges charged on drum 1 by image transfer charging means 10 but also serves to erase any residual charges after cleaning of the residual toner. Second erasing lamp 11*b* is positioned between charging means 3 and exposure station 4 and is adapted to be turned on immediately after formation of electrostatic latent image entirely by actuation of one of microswitches 63 with corresponding cam 62 at which time the original begins to be fed back from left to right as viewed in FIG. 1. Then lamp 11*b* is turned off upon detection of the leading edge of the original by second photo-detection means PC2 during its backward movement. Since charging means 3 and 10 are deenergized by this time, second erasing lamp 11*b* completely erases unnecessary charges placed on drum 1 by charging means 3.

Exposure lamp 4 which is turned on by detection of the leading edge of the original by second photo-detection means PC2 during its forward movement is kept energized for a somewhat longer period of time until the trailing edge of the electrostatic latent image formed on drum 1 enters past point b where shield casing 70 is provided. Shield casing 70 blocks off any light past point b and second erasing lamp 11*b* is turned on only when the trailing edge of the latent image moves past point b within casing 70. In other words, exposure lamp 4 is kept lit for a period of time equal at least to the sum of the time required for image exposure and the time required for the trailing end of the latent image to reach a position where no influence from the light of second erasing lamp 11*b* can be expected. This measure is necessary since the trailing end of the latent image may become erased if second erasing lamp 11*b* is turned on when exposure lamp 4 is turned off. Thus, second erasing lamp 11*b* would be turned on while exposure lamp 4 is still lit. Exposure lamp 4 is extinguished by actuation of one of microswitches 63 by a corresponding control cam 62.

Figure 4:
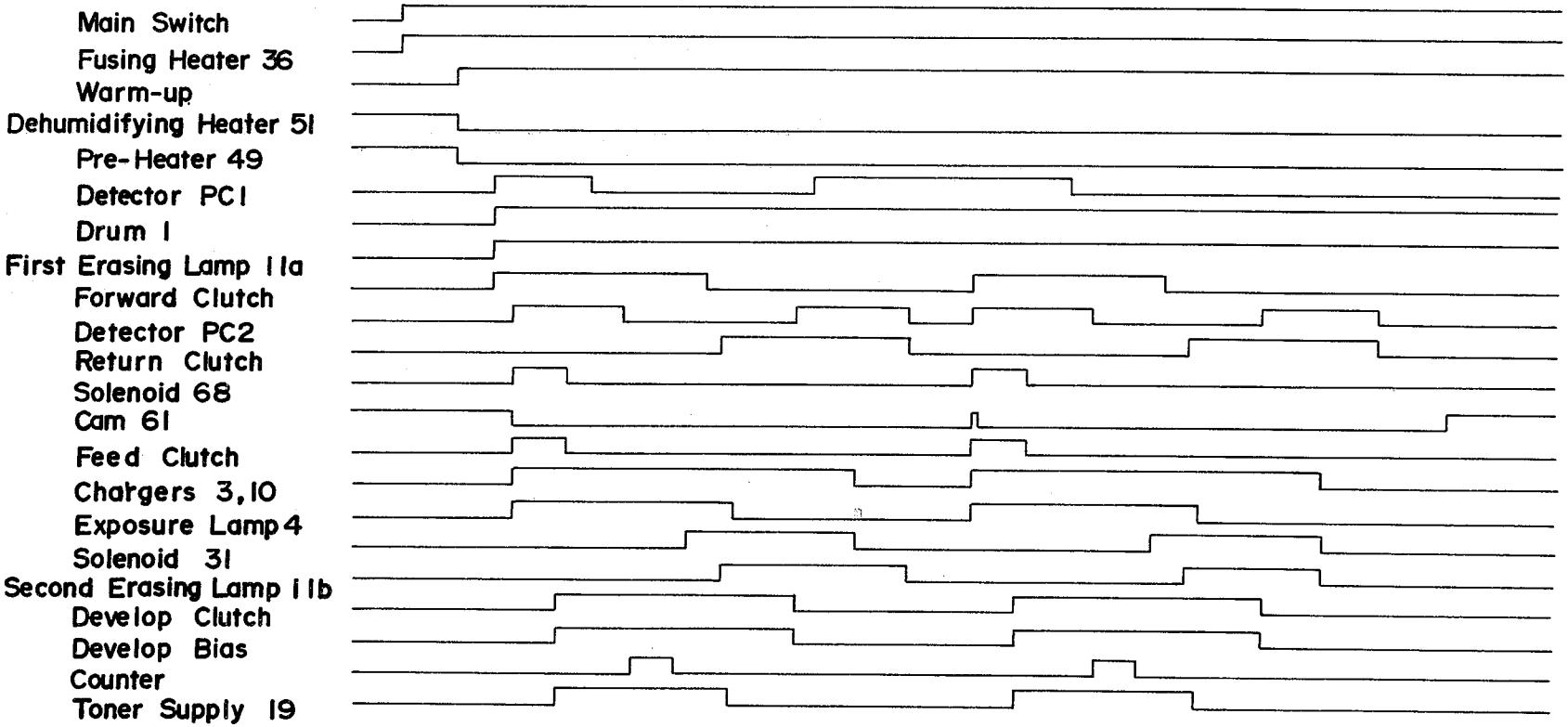
FIG. 4 is a time chart showing sequences of operation of the copying apparatus of FIG. 1.

The copying operation will now be explained by reference to the time chart shown in FIG. 4.

Actuation of a main switch (not shown) energizes fusing heater 36 for fixing means 33 as well as timers which operate pre-heater 49 and dehumidifying heater 51 at predetermined times so as to warm-up the apparatus for copying. Upon insertion of the leading edge of the original between the pair of first original transporting rollers 17*a* and 17*b*, first photo-detection means PC1 is actuated to initiate counterclockwise rotation of photosensitive drum 1. First erasing lamp 11*a* as well as an original forwarding clutch (not shown) are energized to rotate first and second original transporting rollers 17*a*, 17*b*, 18*a*, 18*b* to transport the original leftward. As the original is transported and when second photo-detection means PC2 detects its leading edge, transformer 69 for both charging means 3 and 10 and exposure lamp 4 are actuated. This also actuates control solenoid 68 to rotate engaging lever 57 clockwise, which in turn caused control lever 66 to pivot counter-clockwise. Roller 64 thereof moves out of notched portion 61*a* of position detecting cam 61 thereby rotating cam 61 and a group of control cams 62. The rotations of control cams 62 are inter-related with the rotation of drum 1 such that simultaneously with actuation of detection means PC2, a feed clutch (not shown) is energized to rotate rollers 24*a*, 24*b*, 27*a*, 27*b*, 28*a*, 28*b*, 30 to feed the card 23 from casing 22.

Accordingly, photosensitive drum 1 immediately following the rotation thereof is subject to charging by charging means 3, exposure of an image of the forwardly fed original by exposure lamp 4 and erasing of charges by first erasing means 11*a* from point a, which is the leading edge of the image to be formed. During the exposure of the image onto drum 1, one of control cams 62 actuates corresponding microswitch 63 to energize the clutch for developing means 9, the voltage source for application of developing bias voltage and toner replenishing means 19 so as to successively develop the formed latent image.

Card 23 fed from the casing 22 is prevented from further feeding temporarily when it reaches stopper 32 provided adjacent image transfer charging means 10 and is fed again by moving stopper 32 from the feed path by the actuation of solenoid 31 in a manner such that leading edge a of the image reaches the image transfer station in synchronization with the arrival of the leading edge of the card. The actuation of solenoid 31 is effected by one of microswitches 63 controlled by control cam 62. Thus, as the card is fed between drum 1 and charging means 10, the developed image is transferred thereonto and further fed to fixing means 33 where the transferred image is fixed by rollers 37 and 38 and discharged out of the apparatus.

While corona charging means 10 for effecting transfer of the image has been energized from the time of initiation of the exposure simultaneously with energization of charging means 3, thereby unnecessarily charging the surface of drum 1 until transfer of the image is effected, first erasing lamp 11*a*, which is turned on before initiation of exposure and at the beginning of rotation of the drum, effectively erases these unnecessary charges so that they in no way hinder formation of the latent image, nor will these charges become developed.

Upon formation of the latent image on drum 1 by the exposure, i.e., upon passage of the original past glass plate 20, one of microswitches 63 is turned off to deenergize the original forwarding clutch, thereby stopping the rotation of rollers 17*a*, 17*b*, 18*a*, 18*b*. And when the trailing edge of the latent image enters past a point b within shield casing 70, the original return clutch as well as second erasing lamp 11*b* are energized by actuation of one of microswitches 63 by cam 62. By the above operation, first and second original transporting rollers 17*a*, 17*b*, 18*a*, 18*b* are rotated in the reverse direction to feed back the original while second erasing lamp 11*b* erases unnecessary charges charged on drum 1 in an area following the trailing edge of the latent image, as these charges result from corona charging means 3 which remains energized even after formation of the latent image since transfer of the image by another charging means 10 has not been completed at this point of time. Exposure lamp 4 remains energized until immediately after energization of second erasing lamp 11*b* to assure formation of the latent image up to its trailing edge.

Toner replenishing means 19 suspends its replenishment of toner into container 12 at the time of deenergization of exposure lamp 4 by switching of one of microswitches 63 by a corresponding one of control cams 62. Similarly, the development clutch and application of biasing voltage terminate their operation by receiving a signal from one of microswitches 63 in synchronism with the arrival of the leading edge of the original at second photo-detection means PC2 during its backward movement. Some time later, the operation of both corona charging means 3 and 10 become terminates by switching of a corresponding microswitch 63 by cam 62 which deactuates transformer 69. And at the same time, solenoid 31 is deenergized to move stopper 32 into the feed path. As the original is fed back rightwardly and when its trailing edge moves past second photo-detection means PC2 to turn off the same, the original return clutch becomes deenergized to stop rotation of first and second original transporting rollers 17*a*, 17*b*, 18*a*, 18*b* so that the original is stopped with its end nipped by first original transporting rollers 17*a* and 17*b*. Simultaneously therewith, second erasing lamp 11*b* is turned off by its corresponding microswitch 63 actuated by control cam 62. At this time, position detecting cam 61 would have made one full rotation to receive in the roller 64 of control lever 66 in its notched portion 61*a* indicating that a single copying cycle has been completed. However, first photodetection means PC1 remains actuated because of the presence of the original thereat, and since a counter is set to more than 2 to obtain a plurality of copies from the same original, drum 1 continues to rotate, and as in the manner described above, the original forwarding clutch becomes energized to feed the original forwardly again to repeat the copying operation.

In the last copying cycle, drum 1 after transfer of the developed image onto card 23 passes over first erasing lamp 11*a* for erasure of the residual charges, and in the next rotation (i.e., second rotation for single copying), residual toner is removed by blade 7 and collected by roller 8, which in turn is scraped off by thin leaf 15. And when the original moves past second photo-detection means PC2 in its backward movement in the last copying cycle (or in case of obtaining only one copy), a timer (not shown) is actuated to continue rotation of first original transporting rollers 17*a*, 17*b* until the original is completely moved out of first photo-detection means PC1. This accordingly stops rotation of drum 1 to terminate the copying operation.

Although it was described in the above embodiment that second erasing lamp 11*b* is to be turned on prior to deenergization of exposure lamp 4, it may become apparent that if turning off of exposure lamp 4 is extended until the time second erasing lamp 11*b* is turned off, then exposure lamp 4 itself will have the function of second erasing lamp 11*b* to erase unnecessary charges so that there will no longer be any need for the second erasing lamp. In this case, glass plate 20 should be covered with a suitable member effective to reflect light from the exposure lamp immediately after image exposure, or the light path of lamp 4 should be changed. Additionally, it will be noted that second erasing lamp 11*b* may be disposed in a position between light guide 5 and shield casing 70. In this case, exposure lamp 4 should be turned off when the trailing edge of the latent image enters into shield casing 70 and second erasing lamp 11*b* is to be turned on simultaneously. Also, the present invention is in no way limited to copying apparatus in which both charging means 3 and 10 are operated by single transformer 69, but it is also applicable to the types in which both charging means are controlled separately.

While there have been described preferred embodiments of the present invention, it is apparent that numerous alterations, additions and omissions may be made without departing from the spirit thereof.

What is claimed is:

1. In an image transfer type copying apparatus which includes an image exposure means having an exposure lamp for successively projecting an image of the original onto a photosensitive member and means disposed around said photosensitive member including a charging means for charging the surface of the photosensitive member and remaining operative subsequent to the formation of a latent image thereon, a developing means for developing an electrostatic latent image, an image transfer means for transferring the developed image onto a copying member and cleaning means for cleaning the residual toner, the improvement comprising an erasing means for erasing unnecessary charges formed by said charging means, and a control means therefor wherein said control means energizes said erasing means while said exposure lamp is still lit, said exposure lamp being effective to remain energized even after completion of exposure of the image, and said erasing means is energized when the trailing edge of the latent image reaches a position not influenced by said erasing means.

2. An image transfer type copying apparatus comprising:

a rotatable photosensitive member;

charging means for charging the surface of said photosensitive member;

image exposure means including an exposure lamp for exposing an image of the original for projection onto the photosensitive member so as to form an electrostatic latent image thereon;

developing means for developing the latent image;

transfer means for transferring the developed image onto copying paper;

an erasing means including a lamp for erasing unnecessary charges charged by said charging means and disposed in a position between said charging means and said developing means;

light shielding means provided downstream of said erasing means and an exposure station where the image of the original is projected in a rotating direction of said photosensitive member, said light shielding means being effective to block light from said erasing means at a position downstream thereof; and control means for keeping said exposure lamp lit for a period of time equal to the sum of time required to expose the image of the original and the time required for the trailing edge of the formed latent image to pass the position where said shielding means is provided, said control means energizing said erasing lamp while said exposure lamp is still lit.

3. The apparatus as claimed in claim 2 wherein said transfer means includes a charging means operated integrally with said charging means for charging the surface of the photosensitive member by a single transformer.

4. The apparatus as claimed in claim 3 further including a second erasing means for erasing unnecessary charges charged by said transfer charging means.

5. An image transfer type copying apparatus comprising:

a rotatable photosensitive member;

first charging means for charging the surface of said photosensitive member, said charging means remaining operated even after formation of an electrostatic latent image forming unnecessary charges on the photosensitive member following the trailing edge of the latent image;

image exposure means including an exposure lamp for exposing an image of the original for projection onto said photosensitive member to form the latent image;

developing means for developing the latent image;

transfer means including a second charging means for transferring the developed image onto a copying member, said second charging means being operated integrally with said first charging means;

first erasing means positioned downstream of said second charging means in the rotating direction of said photosensitive member for erasing unnecessary charges charged by said second charging means; and second erasing means for erasing unnecessary charges charged by said first charging means, said second erasing means being positioned between said first charging means and an exposure station where the image is projected, and said exposure lamp is kept lit for a period of time equal to the sum of time required to expose the image and the time required for the trailing edge of the latent image to reach a predetermined position not influenced by light from said second erasing means, and said second erasing means being energized while said exposure lamp is still lit but at such a time that the trailing edge of the latent image has reached said predetermined position.

6. The apparatus as claimed in claim 5 wherein said first erasing means is said exposure lamp which remains lit even after formation of the latent image.

* * * * *